US006206781B1

(12) United States Patent
Sunaga et al.

(10) Patent No.: US 6,206,781 B1
(45) **Date of Patent: *Mar. 27, 2001**

(54) GAME MACHINE WITH REEL LIGHT CONTROL MEANS

(75) Inventors: Isao Sunaga; Hiroyuki Danjo; Yukinori Inamura, all of Tokyo (JP)

(73) Assignee: Aruze Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/012,115

(22) Filed: Jan. 22, 1998

Related U.S. Application Data

(63) Continuation-in-part of application No. 08/919,016, filed on Aug. 27, 1997.

(51) Int. Cl.[7] ..... A63F 5/04
(52) U.S. Cl. ..... 463/20; 463/16
(58) Field of Search ..... 273/138.1, 139, 273/142 R, 142 A, 143 R; 463/1, 16–21, 30

(56) References Cited

U.S. PATENT DOCUMENTS

| | | | | |
|---|---|---|---|---|
| 4,618,150 | | 10/1986 | Kimura | 273/143 |
| 4,718,672 | | 1/1988 | Okada | 273/143 |
| 4,993,713 | | 2/1991 | Harada | 273/138 |
| 5,010,995 | | 4/1991 | Okada | 194/219 |
| 5,018,737 | * | 5/1991 | Okada | 273/143 R |
| 5,127,651 | | 7/1992 | Okada | 273/143 |
| 5,380,008 | * | 1/1995 | Mathis et al. | 273/143 R |
| 5,580,055 | * | 12/1996 | Hagiwara | 273/143 R |
| 5,609,524 | * | 3/1997 | Inoue | 463/20 |
| 5,695,188 | | 12/1997 | Ishibashi | 273/143 |
| 5,704,835 | * | 1/1998 | Dietz, II | 463/20 |

* cited by examiner

*Primary Examiner*—Mark Sager
*Assistant Examiner*—John M. Hotaling, II
(74) *Attorney, Agent, or Firm*—Hutchins, Wheeler & Dittmar

(57) ABSTRACT

In conventional types of slot machines, the prize status is determined by random selection using random numbers for each game. In this type of conventional slot machine, for example, the current game prize status is determined by the random selection of the prize status when a token is put into the slot machine to operate the start lever. When the current game prize status is determined, the reels are rotated to begin the game. In the type of slot machine in which the prize status is determined by random selection using random numbers in the present invention, a demonstration is made by unusual lights or sounds or by unusual operations when the randomly selected prize status is a "big jackpot" or when a "big jackpot" is missed by one reel symbol among all the reels (this condition of two matching symbols is referred to as "one-shy"). In one method for making this demonstration, reel lights are provided on the reverse side of reel belts on which are imprinted the symbols around the reels, and these reel lights, which in conventional slot machines are flashed only when the prize status has been confirmed after all the reels have stopped, are flashed before all the reels stop. In the present invention, a demonstration is made by flashing reel lights when the game prize status is "one-shy," making it possible to provide an exciting game environment which is visually appealing to the player and arouses the anticipation of the player.

18 Claims, 8 Drawing Sheets

GAME MACHINE WITH REEL LIGHT CONTROL MEANS

CROSS-REFERENCE TO RELATED APPLICATION

This application is a continuation in part of U.S. patent application titled "Game Machine," Ser. No. 08/919,016, filed Aug. 27, 1997, pending, the contents of which are hereby incorporated by reference.

FIELD OF THE INVENTION

The present invention relates to a slot machine, and more particularly to a slot machine in which an unusual demonstration signals that a player has won a prize.

BACKGROUND

Game machines, such as slot machines and poker game machines, that pay back tokens, such as coins or token coins, for winning game results have been very popular. Herein, such a slot machine will be used as an example of a game machine and will be described below.

Players start a game by pulling a start lever, for example, after putting a token into the slot machine. A plurality (three, for example) of reels with numerous types of symbols arranged on the circumference rotate at high speed in the slot machine, and the prize status is determined by the combination of the symbols on the reels displayed at a given location in the window when the reels have stopped. The number of tokens that are paid out is determined by the combination of symbols when the reels have stopped, that is, the prize status.

Slot machine prizes include "bigjackpots," where 1000 or more tokens, for example, are paid back, and so-called "small jackpots." The player plays the slot machine in anticipation of increasing the number of tokens in the player's possession, but since the number of tokens in the player's possession does not increase significantly with "small jackpots," the player plays the slot machine while hoping for a "big jackpot" that will quickly increase the number of tokens in the player's possession.

In one type of slot machine, the prize status is determined by random selection using random numbers for each game. This type of slot machine is described below.

In the type of slot machine in which the prize status is determined by random selection using random numbers for each game, for example, the prize status is randomly selected when a token is put into the slot machine and the start lever is pulled, and the current game prize status is determined. When the current game prize status has been determined, the reels are rotated to begin the game.

However, among the types of slot machines in which the prize status is determined by random selection using random numbers for each game, there are those in which the player can stop the reels by operating a stop button provided in the slot machine. In this type of slot machine, the reels are not immediately stopped according to the timing by which the player operates the stop button, but are instead stopped when the reel symbols appear at the locations corresponding to the prize status previously determined by random selection.

However, when too long a time passes until the reels stop after the player has operated the stop button, unnatural reel stopping operations can result, and the reels can be stopped regardless of the prize status previously determined by random selection. Accordingly, there can be cases where the prize status might end up as a "lose" due to the timing with which the player actuates the stop buttons, even when the prize status previously determined by random selection would have been a "big jackpot."

Among the types of slot machines in which the prize status is determined by random selection using random numbers for each game, there are also those in which no stop button is provided to stop the reels, but the reels are automatically stopped by a control in the slot machine. In this type of slot machine, the reels are stopped when the reel symbols appear at the position corresponding to the prize status previously determined by random selection after the reels have rotated for a specific period of time.

SUMMARY OF THE INVENTION

In the type of slot machines in which the prize status is determined by random selection using random numbers for each game, the prize status is randomly selected when a token has been put into the slot machine and the start lever has been pulled, so the prize status of the current game is already known when the reels begin to rotate. As described above, the player plays slot machines hoping for a "big jackpot" to quickly increase the number of tokens in the player's possession, and when it is known that the current game will result in a "big jackpot," for example, as a result of the previous random selection, it would be significant to make a demonstration alerting the player to that fact before all the reels have stopped.

In the type of slot machine in which the prize status is determined by random selection using random numbers in the present invention, a demonstration is made by unusual lights or sounds or by unusual operations when the randomly selected prize status is a "big jackpot" or when a "big jackpot" is missed by one reel symbol among all the reels, i.e., all but one of the reels are aligned in positions that would correlate to a "big jackpot" result (this condition of two matching symbols out of three reels, or of three matching symbols out of four reels if there are four reels, etc., is referred to as a "one-shy" condition). In one method for making this demonstration, reel lights are provided on the reverse side of reel belts on which are imprinted the symbols around the reels, and these reel lights, which in conventional slot machines are flashed only when the prize status has been confirmed after all the reels have stopped, are flashed before all the reels stop.

A slot machine according to the systems and methods described herein randomly selects game result conditions from among a plurality of conditions before a plurality of reels, which are rotated at the start of a game, come to a stop. Such a slot machine is characterized by comprising reel light control means for flashing the reel lights on the inside, which illuminate the symbols imprinted on the circumference of the aforementioned plurality of reels when the randomly selected game results correspond to specific conditions, such as "big jackpot" or "small jackpot." A player is alerted by said reel light control means to the fact that the aforementioned randomly selected game results correspond to the aforementioned specific conditions.

The systems and methods set forth herein also describe a slot machine in which the aforementioned reel light control means flashes the aforementioned reel lights when there are quasi-specific conditions, including, for example, one or more game result conditions, such as "one-shy", "two-shy", and "second game free," which are similar to the aforementioned specific conditions, among the aforementioned plurality of conditions, and the aforementioned quasi-specific conditions are randomly selected from among the aforementioned plurality of conditions.

DETAILED DESCRIPTION OF PREFERRED EMBODIMENTS

The present invention is described below with reference to the drawings.

Figure 1:
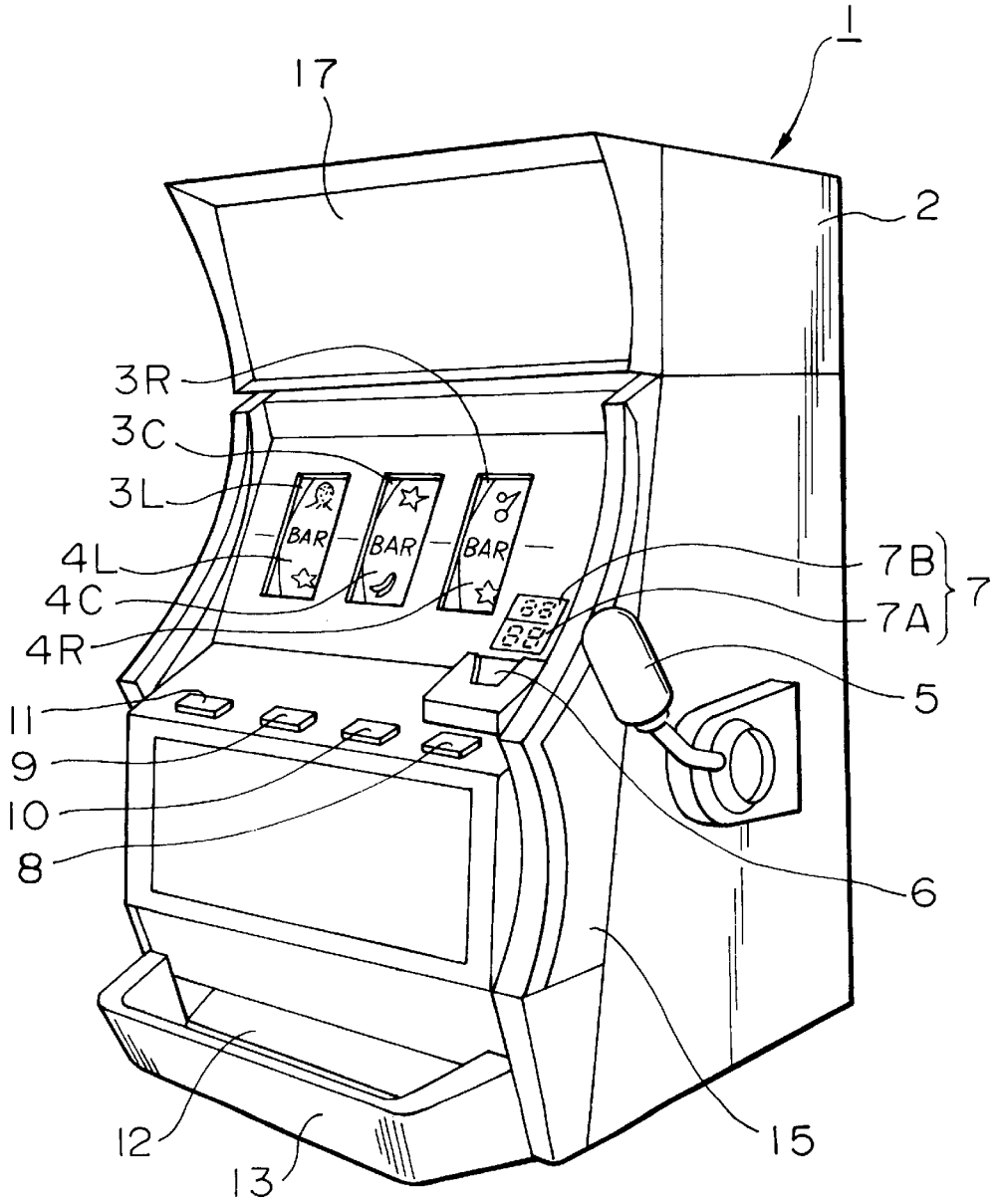
FIG. 1 illustrates the appearance of a slot machine in an embodiment of the present invention.

FIG. 1 illustrates the appearance of a slot machine in an embodiment of the present invention. The slot machine in FIG. 1 includes a main unit 1. A cabinet 2 having a front face constituting the entire main unit 1 is provided with windows 3L, 3C, 3R corresponding to a plurality of reels 4L, 4C, 4R, (three in the case of FIG. 1), for viewing the symbols on each of the reels 4L, 4C, 4R located inside the cabinet 2. The upper front face of the main unit 1 is provided with a display panel 17 giving the combinations of winning symbols, list of winnings, and the like. A front door panel 15 is shown, which door panel 15 can be opened and closed on the main unit 1 to inspect and repair the interior of the main unit 1, collect or replenish tokens, and the like. The front door panel 15 has the windows 3L, 3C, 3R for viewing the reels located on the main unit 1 side. A start lever 5 for rotating the reels 4L, 4C, 4R when operated by a player is rotatably attached at a prescribed angle on a side face of the cabinet 2. A token inlet 6 for entering tokens and a digital display 7, comprising a credit number display 7A for displaying the number of tokens currently credited and a prize number display 7B for displaying the number of tokens won in the current game, are provided on the lower right side of the windows 3L, 3C, 3R on the front face of the cabinet 2.

Arranged below the windows 3L, 3C, 3R on the front face of the cabinet 2 are a spin switch 8 for setting the reels 4L, 4R, 4C in motion by the operation of a push button which is separate from the operation of the start lever 5, a single bet switch 9 for betting just one token from among the credited tokens on the game when the push button is pressed once, a maximum bet switch 10 allowing the maximum possible number of tokens to be bet on a single game when the push button is pressed once, a "C/P" switch 11 for switching between play credit/pay out of the tokens won by the player when the push button is pressed, and a token receptacle 13 for receiving tokens paid out from a token pay outlet 12 at the bottom of the front face when the "C/P" switch 11 is switched.

Figure 2:
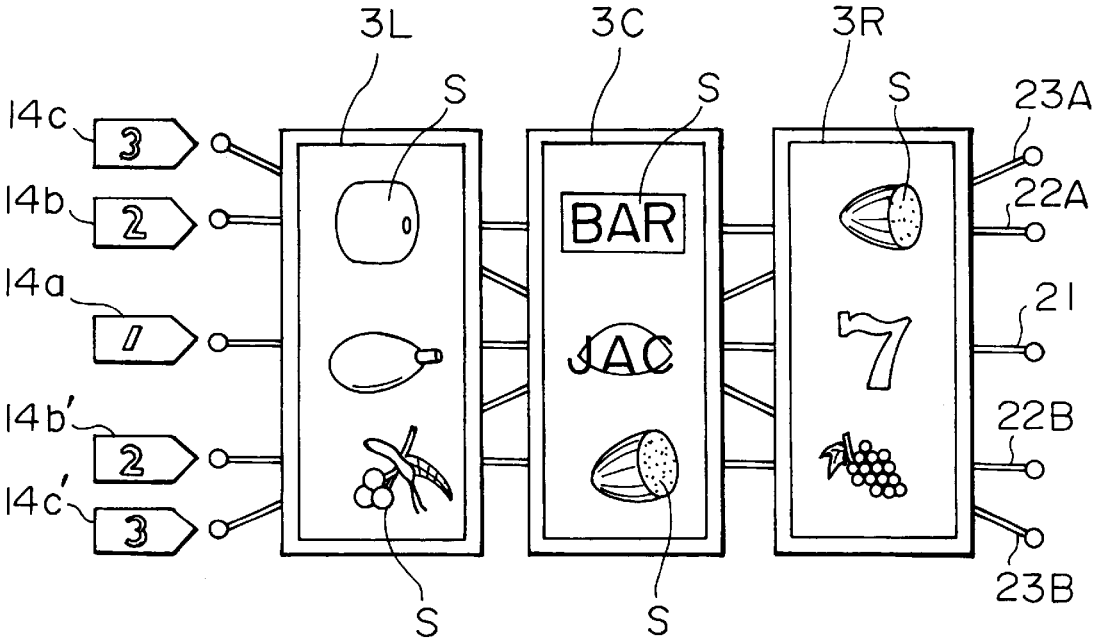
FIG. 2 is a detail of the window for viewing the reels of the slot machine depicted in FIG. 1.

FIG. 2 is a detailed view of the window for viewing the reels 4L, 4R, 4C of the slot machine depicted in FIG. 1. In this example of a slot machine, the number of prize lines can be selected according to the number of tokens entered (number of tokens bet on the game) prior to the start of the game. That is, in FIG. 2, three symbols "S" on each reel can be seen through the windows 3L, 3C, 3R. When one token is entered, only a single line 21 is activated per prize determination; when two tokens are entered, a total of three lines comprising lines 21, 22A, and 22B are activated per prize determination; and when three tokens are entered, a total of five lines comprising lines 21, 22A, 22B, 23A, and 23B are activated. In FIG. 2, a set of lamps 14*a*, 14*b*, 14*c*, 14*b*', 14*c*', which are marked with the characters "1", "2", and "3", lights up to display the lines that have been activated according to the number of tokens entered. The selection of the number of active lines is determined, for example, by the number of tokens entered prior to the operation of the start lever 5 or the spin switch 8.

The display lamps 14*a*, 14*b*, 14*c*, 14*b*', 14*c*' are connected so as to light up to display the lines that have been activated according to the number of tokens entered. Thus, the selection of the number of active lines is determined by the number of tokens entered prior to the operation of either the start lever 5 or the spin switch 8, or, alternatively, by the number of tokens entered after the operation of the start lever 5 and prior to the operation of the spin switch 8. When one token is entered, only one line, which is associated with one display lamp 14*a* and mark "1", is activated per prize determination; when two tokens are entered, a total of three lines, which are associated with three display lamps 14*a*, 14*b*, 14*b*' and the marks "1" and "2" are activated per prize determination; and when three tokens are entered, a total of five lines, which are associated with all five of the display lamps 14*a*, 14*b*, 14*c*, 14*b*', 14*c*' and with the marks "1", "2" and "3", are activated. This selection is done in accordance with the flowchart shown in FIG. 3.

The selection of the number of active lines may be based on a microswitch, photosensor, or other such electrical signal-based device for detection of the insertion of a token and the determination as to whether or not the start lever 5 or spin switch 8 has been operated. In the "active line" process in FIG. 3, one or more of the display lamps 14*a*, 14*b*, 14*c*, 14*b*', 14*c*' are turned on, and at the same time, a signal is input to the microcomputer described below so as to be taken into account during the determination of the prize.

Figure 3:
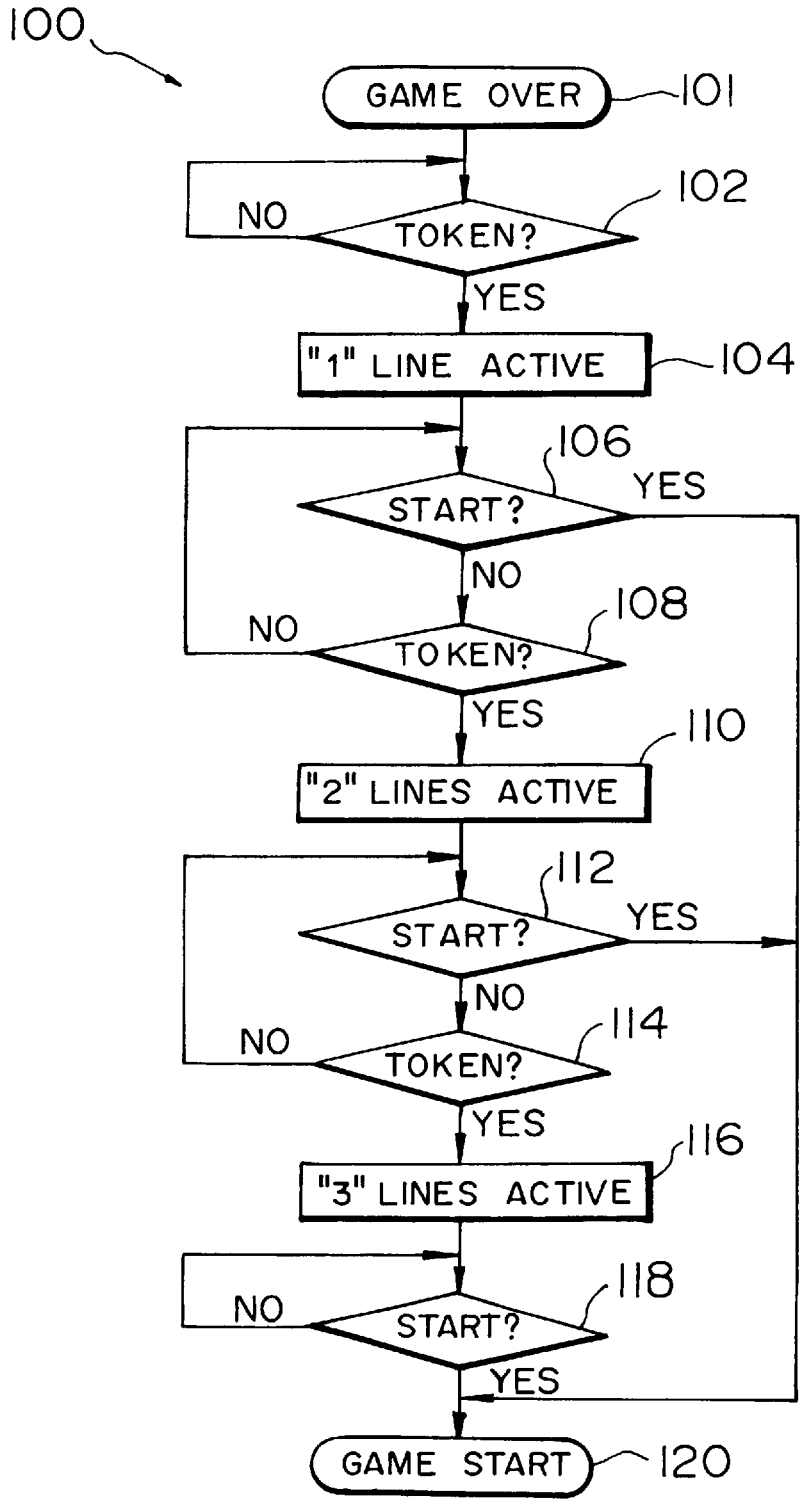
FIG. 3 is a flow chart of a process for determining active prize lines.

FIG. 3 is a flowchart 100 illustrating the selection of lines to activate by lighting up one or more of the lamps 14*a*, 14*b*, 14*c*, 14*b*', 14*c*' . The selection may be made using a microswitch, a photosensor, or another similar electrical signal-based system for detection of the insertion of a token and determination as to whether or not the start lever 5, or the spin switch 8, or both, have been operated. In the flowchart 100, the line activation process starts at a step 101 indicating conclusion of a prior game. Following the step 101 is a test step 102 that determines whether a token has been entered. The test step 102 is repeated until a token is entered. Once a token has been entered, control passes to a step 104 so that a single display lamp 14*a* will be lit to activate a single line, which is marked with a "1" in FIG. 1. Following the step 104 is a test step 106 that determines whether the start lever 5 has been pulled. If the start lever 5 has been pulled, then the game proceeds to a game start step 120 and the game starts. Otherwise, a test step 108 determines whether a second token has been entered. The test steps 106, 108 are repeated until either the start lever 5 is pulled or a second token is entered. If a second token is entered, control passes to a step 110 that indicates that two more lamps 14*b*, 14*b*' will be lit to activate two more lines, which are marked with a "2" in FIG. 1, for a total of three lines activated. Following the step 110, a test step 112 is performed to test whether the start lever 5 has been pulled. If the start lever 5 has been pulled, control passes from the step 112 to the game start step 120. Otherwise, a test step 114 is performed to determine whether a third token has been entered. The steps 112, 114 are repeated until either the start lever 5 is pulled or a third token is entered. If a third token is entered, two more display lamps 14*c*, 14*c*', which are marked with a "3" in FIG. 1, will be lit to activate two more lines, for a total of five lines activated. A test step 118 is then performed to determine whether the start lever 5 has been pulled. If the start lever 5 has been pulled, then control passes to the game start step 120. Otherwise, the test step 118 is repeated. In the "active line" process shown in FIG. 3, one or more of the display lamps 14*a*, 14*b*, 14*c*, 14*b*', 14*c*' are turned on depending on the number of tokens entered, and, at the same time, a signal is input to the microcomputer, as described below, so that the number of token entered is taken into account during the determination of the prize.

Figure 4:
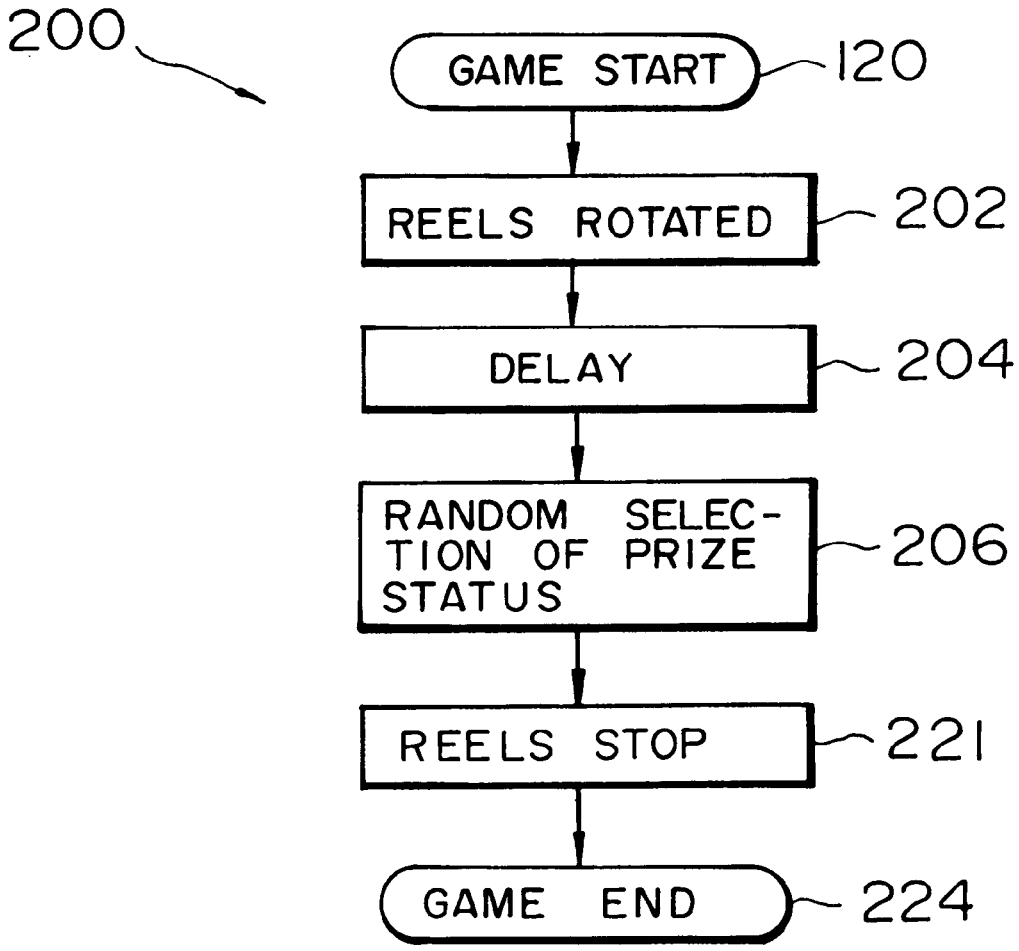
FIG. 4 is a flow chart of a basic game progress of a slot machine according to an embodiment of the present invention.

After the number of prize lines has thus been determined, the game basically progresses according to the flow chart in FIG. 4. That is, the game starts when the start lever 5 or spin switch 8 is operated, the three reels rotate, the prize status described below is randomly selected after a prescribed period of time has passed, the reels automatically stop based on the randomly selected results, and the current game is terminated.

FIG. 4 is a flowchart 200 illustrating progress of the game once the number of prize lines has been determined in accordance with the process shown in FIG. 3 (or by following one of a variety of conventional processes equivalent to that shown in FIG. 3). The game begins at the game start step 120 (of FIG. 3). A reel rotation step 202 follows the start step 120. Following the reel rotation step 202 is a delay step 204. Following the delay step 204 is a result selection step 206 in which the results for a plurality of games are randomly selected to provide a random selection of prize status. Following the result selection step 206 is a reels stop step 221 in which the reels are stopped, optionally in response to a player's pressing of stop buttons. After the step 221, control passes to a game end step 224.

Figure 5:
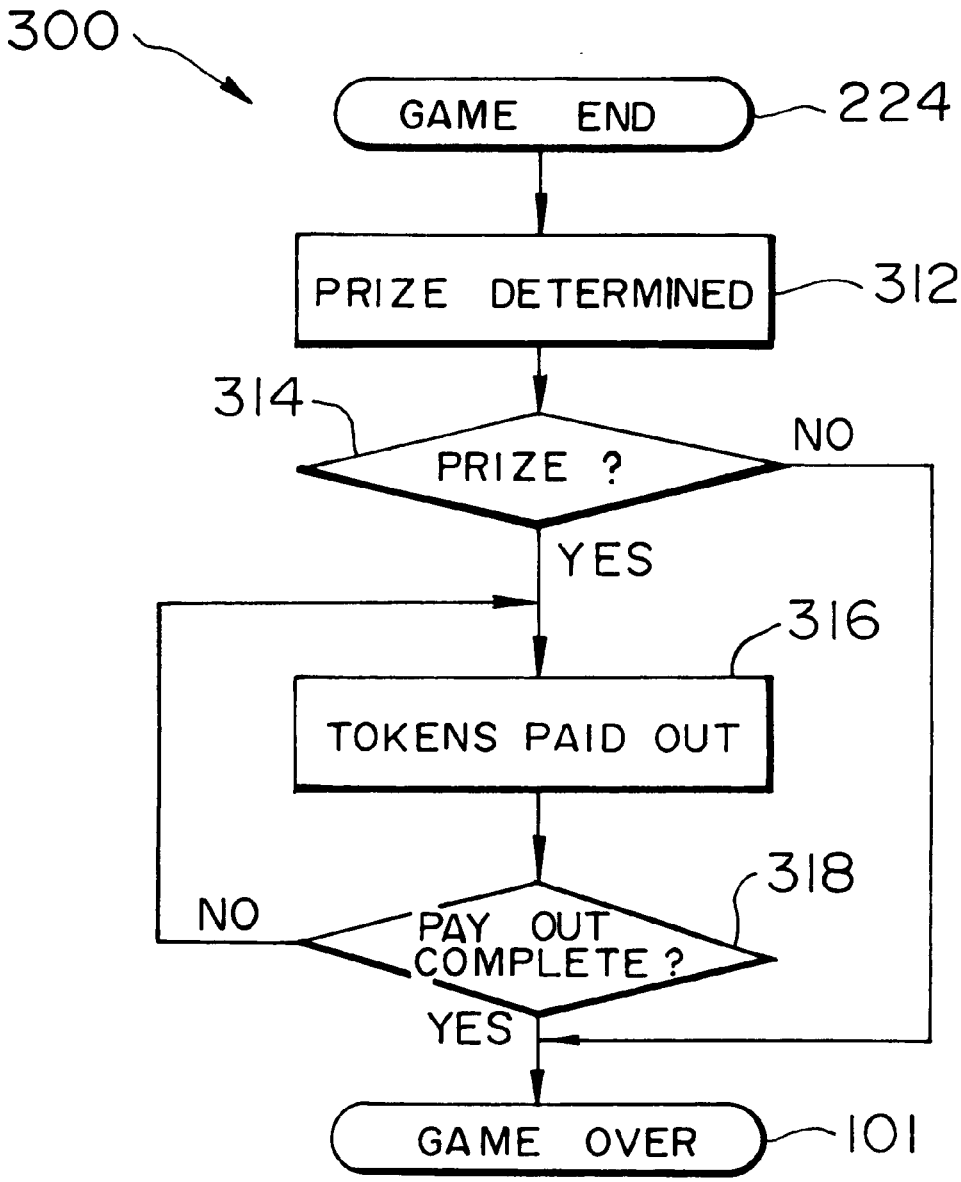
FIG. 5 is a flow chart of a process from the determination of the prize to the pay out of tokens.

When the game is over, the process for determining the prize is carried out according to the flow chart in FIG. 5, for example, and tokens are paid out when a prize has been won.

FIG. 5 is a flowchart 300 illustrating the determination of the prize when the game is over. Following the game end step 224 (of FIG. 4), control passes to a step 312 in which determination of the prize is made. Following the step 312 is a test step 314 which tests whether a prize was won. If so, control passes to a step 316. Otherwise, control passes to the game over step 101 (of FIG. 3). In the step 316, the prize tokens are paid out in the proper amount. Following the step 316 is a test step 318 in which it is determined whether the paying out has been completed. If so, control passes to the game over step 101. Otherwise, control returns to the step 316 and the process is repeated until the game over step 101 is reached.

During the determination of a prize, photoelectric signal components provided for the symbols on the reels are read by photosensors, or signal components are provided at a location on the reels so that reset pulses are obtained for each reel rotation by pulse motors that drive the reels, allowing it to be determined whether a pulse signal has been supplied for any pulse to the pulse motor until the reels are stopped following the production of the reset pulse.

In the prize determination, the symbols of the reels are used as code signals as described above, and the combination is matched with the ROM described below. When a prize has been won, a hopper motor for paying out prize tokens is driven to pay out the prize tokens. The tokens that are paid out are counted, for example, by a token counter located in the token pay out chute, and the game is over when the prescribed number of tokens has been reached.

Figure 6:
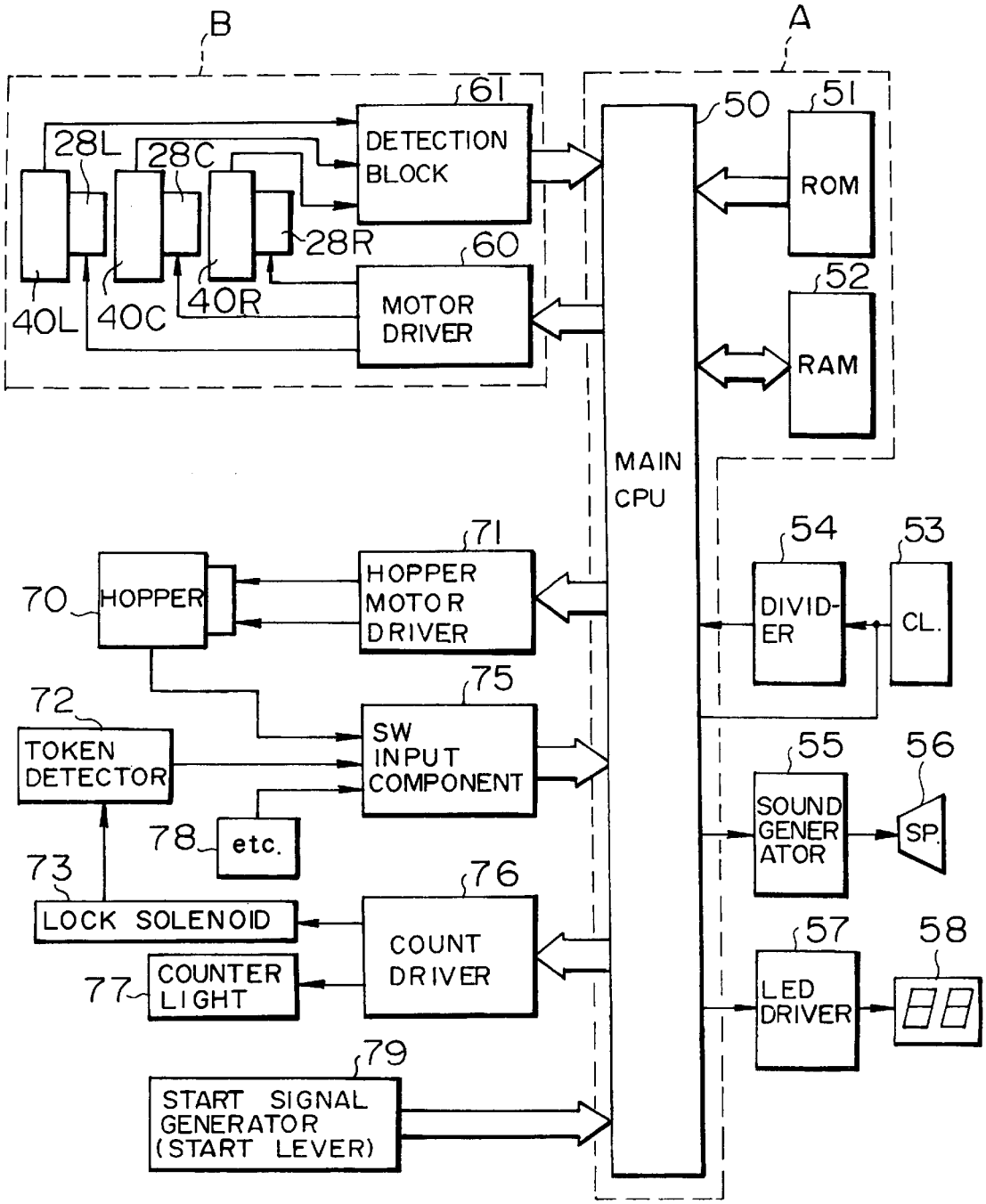
FIG. 6 is a block diagram depicting a microcomputer controlling the slot machine in one embodiment of the present invention.

FIG. 6 is a block diagram depicting the microcomputer controlling the slot machine in the present embodiment. In FIG. 6, the broken line block A is a main control component having a main CPU 50, ROM 51, and RAM 52. The ROM 51 stores a correspondence table of the symbols described above and symbol codes, a table of symbol codes corresponding to prizes and the number of prize tokens paid out, as well as prize probability tables and the like corresponding to the prize status when a prize is awarded for the game that has been run. The RAM 52 prepares random number stores for temporarily storing random numbers sampled after the start of a game, memory for temporarily storing data such as rotating reel code numbers and symbols, and the like.

In FIG. 6, the broken line block A is a main control component having a main CPU 50, a ROM 51, and a RAM 52. The ROM 51 stores a correspondence table of the symbols described above and symbol codes, a table of symbol codes corresponding to prizes and the number of prize tokens paid out, as well as prize probability tables and the like according to prize status when a prize is awarded for the game that has been run. The RAM 52 prepares random number stores for temporarily storing random numbers sampled after the start of a game, memory for temporarily storing data such as rotating reel code numbers and symbols, and the like.

A clock pulse generator 53 generates, for example, a four MHZ pulse, and that actuates the main CPU 50 based on this standard pulse, and a divider 54 gives an interruption pulse of 500 Hz, for example, to the main CPU 50 for the interrupt execution process of a prescribed program. A sound generator 55 is driven so as to produce sounds by means of a speaker 56 in order to enhance game interest at prescribed periods after the start of the game. The speaker 56 can be used as the demonstration means described below. An LED drive component 57 drives a seven-segment digital display light-emitting diode 58, for example. This diode 58 can be used to display the number of tokens paid out or the like.

The broken line block B in FIG. 6 is a reel drive view block. In this embodiment, reels 4L, 4C, 4R are driven by pulse motors 40L, 40C, 40R. The motors 40L, 40C, 40R are rotated by drive pulses from a motor drive component 60. For example, the reels are rotated one reel symbol at a time, as seen through windows 3L, 3C, 3R, per pulse. The reels are constructed in such a way that a reset signal is produced per rotation. The reset signals are detected by a detection block 61. In the main CPU 50, the reset signals are detected by the detection block 61, and the number of drive pulses given by the motor is then counted, allowing the reel symbols visible in the windows 3L, 3C, 3R to be specified.

In the prize determination, the symbols of the reels are used as code signals as described above, and the combination is matched with the ROM described below. A prize token pay out hopper 70 and a hopper motor drive component 71 also are shown. A token detector 72 detects the insertion of tokens prior to the start of the game. When a prize has been won, the hopper motor for paying out prize tokens is driven to pay out the prize tokens. The tokens that are paid out are counted, for example, by the token counter 72 located in the token pay out chute, and the game is over when the prescribed number of tokens has been reached. The signal for the number of tokens paid out from the hopper 70 and the signal for the number of tokens entered from the token detector 72 are sent via a "Sw" input component 75 and main CPU 50 from a count driver component 76 to a counter light or lamp 77, the number of tokens entered or paid out is detected, or one or more of the display lamps 14*a*, 14*b*, 14*c*, 14*b*', 14*c*' for the active prize lines are lit up according to the number of tokens entered. The display lamps 14*a*, 14*b*, 14*c*, 14*b*', 14*c*' can also be used as the demonstration means described below. When three tokens are entered, a lock solenoid 73 that locks the entered tokens is driven. Another switch operating component 78, such as an interrupt or stop switch or the like, is operated when a player wishes to interrupt or stop a game after a token has been entered. A start signal generator 79 is constructed, for example, of the aforementioned start lever 5 or spin switch 8.

The system structure described above allows the determination process for the basic progress of the game shown in the flow charts above to be carried out by the prescribed executing program using the main CPU 50.

The structure of the slot machine in the present embodiment is further described below.

Figure 7:
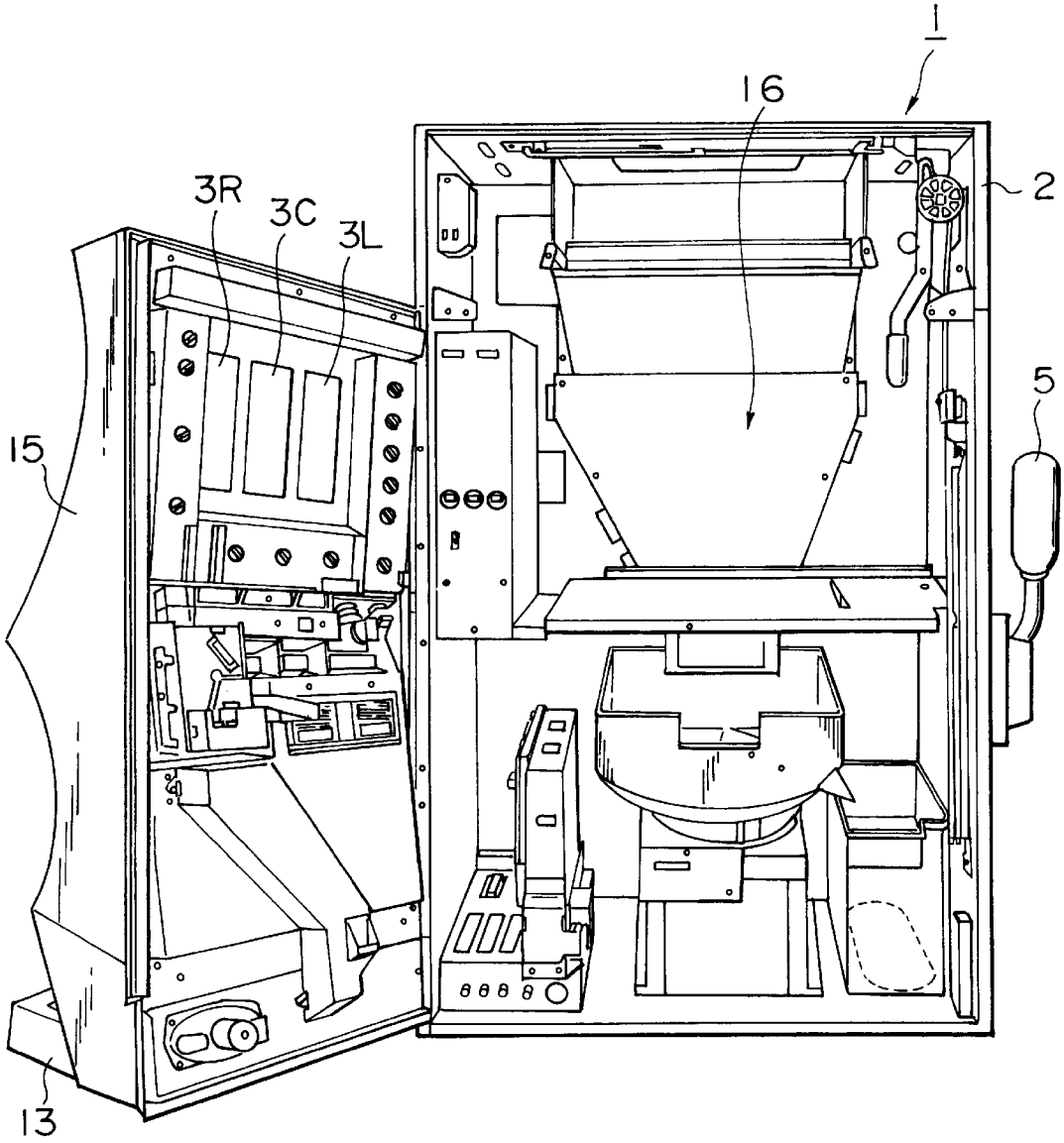
FIG. 7 is an illustration of the main unit of the slot machine depicted in FIG. 1 with the front door panel open.

FIG. 7 is an illustration of the main unit of the slot machine depicted in FIG. 1 with the front door panel 15 open. As described above, the front door panel 15 has windows 3L, 3C, 3R, and a reel unit lay-out component 16, in which the reel unit 20 depicted in FIG. 8 is laid out, is located at a position facing the windows 3L, 3C, 3R inside the cabinet 2.

Figure 8:
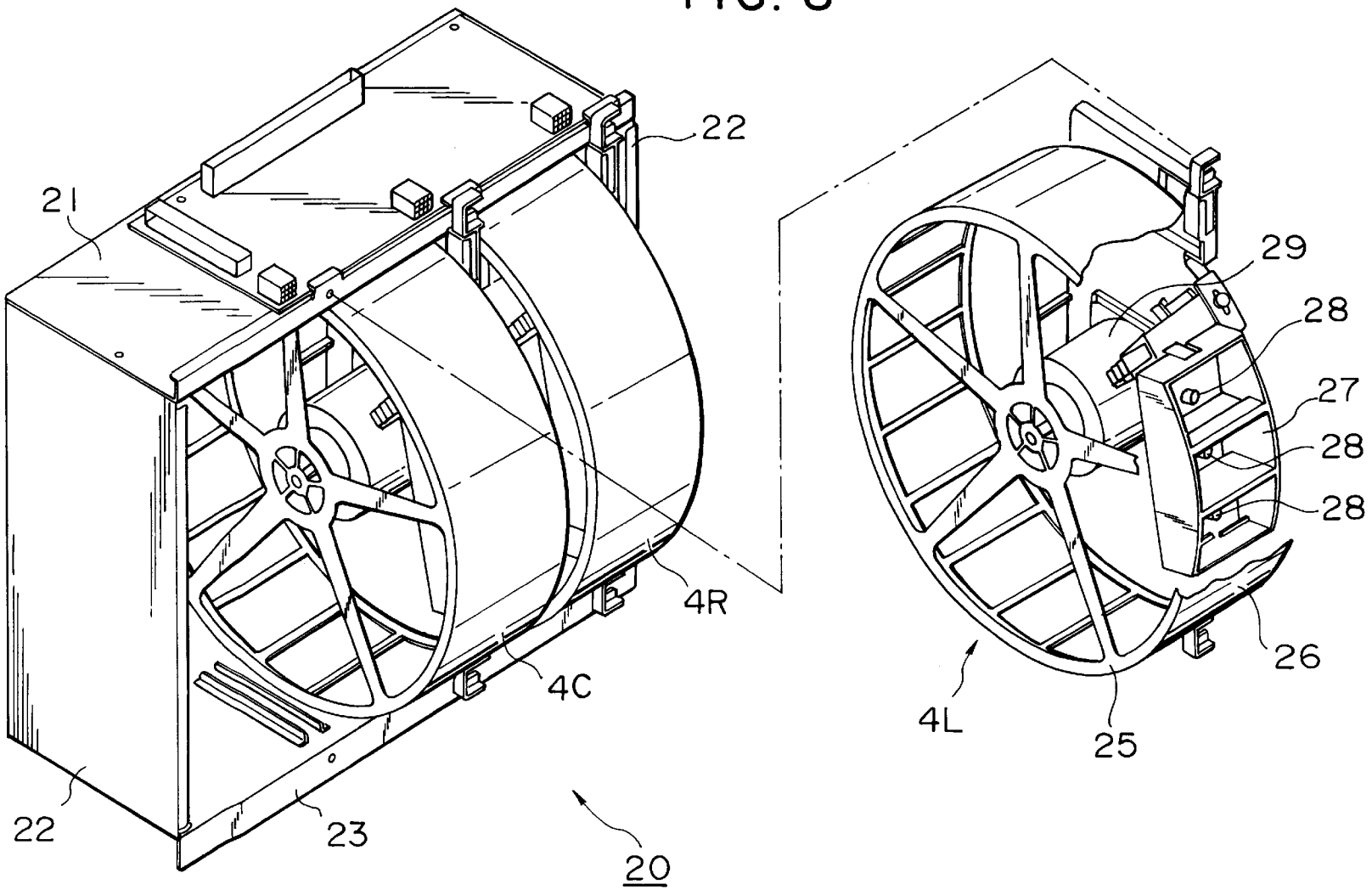
FIG. 8 is an oblique view of the reel unit of the slot machine depicted in FIG. 1.

FIG. 8 is an oblique view of the reel unit. In FIG. 8, reel 4L is shown in isolation. The reel unit 20 is encased by a reel top cover 21, reel side covers 22, and a reel base cover 23. Reels 4L, 4C, 4R are housed in this structure. This reel unit 20 is set up in the reel unit lay-out component 16 depicted in FIG. 7. Reels 4C and 4R have the same structure as reel 4L, so reel 4L is described as representative of all the reels.

In FIG. 8, reel 4L is depicted with a cut-away of the reel belt 26 and reel drum 25, so as to reveal the reel light case 27 and reel lights 28. Reel 4L is composed of a reel drum 25; a reel belt 26 which is fixed to the reel drum 25 and on which are imprinted the symbols; a reel light case 27 and reel lights 28 located at fixed positions irrespective of the rotation of the reel drum 25; and a motor 29 for rotating the reel drum 25.

The reel light case 27 of reel 4L is located in a position that faces the window 3L when the front door panel 15 is closed. As shown in FIG. 8, the reel light case 27 of reel 4L is divided into three chambers. The reel light cases of reels 4C and 4R are similarly located at positions that face the windows 3C and 3R when the front door panel 15 is closed. A reel light 28 is located in each of the three chambers of the reel light case 27. The three symbols visible through the window 3L are illuminated by the three reel lights 28 from the inside of the reel belt 26 to make the symbols stand out. In conventional slot machines, these reel lights 28 are usually turned off, and are flashed only when a prize has been confirmed after all the reels 4L, 4C, 4R have stopped.

The method for presentations which are made according to the prize status, and which are a distinctive feature of the present invention, is described below.

As described above, the prize status is randomly selected as result of a match between the random number values sampled at the start of the game and the groups of numerical values for awarding a prize which are stored in the prize table in the ROM.

In the type of slot machine in which the prize status is determined by random selection using random numbers for each game in the present embodiment, a demonstration is made by unusual lights or sounds or by unusual operations when the randomly selected prize status of the current game is a "big jackpot" or when a big jackpot is missed by one reel symbol among all the reels (this condition of two matching symbols is referred to as "one-shy").

Specifically, the presentation in the present embodiment is effected by flashing the reel lights 28 depicted in FIG. 8. That is, when the prize status determined by random selection in the current game is "one-shy," a presentation is made by flashing the reel lights 28 at a prescribed time before the three rotating reels have all stopped once the game has been started by the operation of the start lever 5 or spin switch 8.

In the slot machine in the present embodiment, the three reels 4L, 4C, 4R begin to rotate simultaneously when the start lever 5 or spin switch 8 is operated, and reel 4L automatically stops first, followed by reel 4C. As described above, the randomly determined prize status of the first game is determined before the reels 4L, 4C, 4R stop. In the present embodiment, after reels 4L and 4C have stopped but before reel 4R stops, a demonstration, that is, the flashing of the reel lights 28, begins when there is a possibility of a "big jackpot" based on the symbol of reel 4R. After the demonstration has begun, the time until reel 4R stops should be somewhat longer than usual to prolong the time of the demonstration. This has the effect of allowing the player to enjoy a greater sense of anticipation. When reel 4R then automatically stops and the randomly determined prize status of the current game is not a "big jackpot," the reel lights 28 stop flashing and go out. When, on the other hand, the randomly determined prize status of the current game is a "big jackpot," the reel lights 28 continue to flash after reel 4R has automatically stopped.

In the embodiment described above, a demonstration, that is, the flashing of the reel lights 28, begins after two of the three reels 4L, 4C, 4R have stopped, but the present invention is not limited to this. For example, a demonstration may begin when the three reels 4L, 4C, 4R begin to rotate simultaneously, or a demonstration may begin after one of the three reels 4L, 4C, 4R has stopped.

As described above, a demonstration is made by flashing reel lights 28 in the present invention when the game prize status is "one-shy," making it possible to provide an exciting game environment which is visually appealing to the player and arouses the anticipation of the player.

While the invention has been disclosed in connection with the preferred embodiments shown and described in detail, various modifications and improvements thereon will become readily apparent to those skilled in the art. Accordingly, the spirit and scope of the present invention is to be limited only by the following claims.

What is claimed is:

1. A method of operating a slot machine, comprising:

randomly selecting game result conditions from among a plurality of conditions that include at least a first specific condition corresponding to a win condition and a second specific condition corresponding to a one-shy condition, before a plurality of reels, which are rotated at the start of a game, come to a stop, wherein said slot machine includes reel light control means for flashing the reel lights on the inside which illuminate the symbols imprinted on the circumference of the aforementioned plurality of reels when the randomly selected game results correspond to specific conditions;

initiating flashing of said reel light control means upon selecting said first or second specific conditions;

in response to the first specific condition, continuing to flash at least one reel light of said reel light control means after all of the reels have come to a stop; and in response to the second specific condition, stopping the reel light control means from flashing when all of the reels have come to a stop; and a player is alerted by said reel light control means to the fact that the aforementioned randomly selected game result condition corresponds to one of the aforementioned specific conditions when the rotation of all but one specific reel among the aforementioned plurality of reels has stopped.

2. A method of operating slot machine as defined in claim 1, wherein the timing for stopping the aforementioned one specific reel is slower than usual when the rotation of all but the one specific reel among the aforementioned plurality of reels has stopped.

3. A game machine, comprising;

a plurality of rotatable reels that stop rotating at a position that varies according to a predetermined game result, wherein said predetermined game result includes at least first and second possible outcomes, said first outcome corresponding to a win condition and said second outcome corresponding to a one-shy condition; and reel lights, coupled to the reels, wherein, prior to all of the reels coming to a stop, at least one of the reel lights is actuated to indicate that the predetermined game result meets a specific game condition corresponding to at least one of said first and second outcomes, and wherein, in response to the first outcome, at least one of the reel lights is actuated after all of the reels have come to a stop and wherein, in response to the second outcome, the reel lights are unactuated when all of the reels have come to a stop.

4. A game machine, according to claim 3, wherein at least one of the reel lights indicates that the game result meets at least one additional game condition similar to the specific game condition.

5. A game machine, according to claim 4, wherein the at least one of the reel lights is actuated when all but a last one of the reels has stopped rotating.

6. A game machine, according to claim 5, wherein a time of rotation is extended for the last one of the reels in response to one of the game conditions being met.

7. A game machine, according to claim 6, wherein the reel lights are actuated after the reels stop in response to the specific game condition being met.

8. A game machine, according to claim 4, wherein the at least one of the reel lights is actuated when all the reels are rotating.

9. A game machine, comprising;

game result determining means, for providing a predetermined game result;

actuator means, responsive to the game result determining means, for rotating a plurality of reels and for stopping the reels at a position that varies according to the predetermined game result, wherein said predetermined game result includes at least first and second possible outcomes, said first outcome corresponding to a win condition and said second outcome corresponding to a one-shy condition; and reel light means, responsive to the game result determining means, being actuated to indicate that the predetermined game result prior to all of the reels coming to a stop, wherein, in response to the first outcome, said reel light means continues to actuate after all or the reels have come to a stop, and wherein, in response to the second outcome, said reel light means are unactuated when all of the reels have come to a stop.

10. A game machine, according to claim 9, wherein the reel light means includes at least one reel light coupled to at least one reel.

11. A game machine, according to claim 10, wherein the at least one reel light is extinguished when the at least one reel stops and the predetermined game result does not include one of: "big jackpot" and "one shy".

12. A game machine, according to claim 10, wherein the at least one of the reel lights is actuated when only the at least one reel is rotating.

13. A game machine, according to claim 12, wherein a time of rotation is extended for the at least one reel in response to the predetermined game condition being one of: "big jackpot" and "one shy".

14. A game machine, according to claim 13, wherein the at least one reel light is actuated after the at least one reel stops.

15. A method of playing a game, comprising:

providing a predetermined game result, wherein said predetermined game result includes at least first and second possible outcomes, said first outcome corresponding to a win condition and said second outcome corresponding to a one-shy condition;

rotating a plurality of reels;

stopping the reels at a position that varies according to the predetermined game result, indicating the predetermined game result prior to all of the reels coming to a stop by actuating at least one reel light that is coupled to at least one of the reels;

in response to the first outcome, continuing to actuate the at least one reel light after all of the reels have come to a stop; and in response to second outcome, unactuating the at least one reel light when all of the reels have come to a stop.

16. A method, according to claim 15, further comprising:

extinguishing the at least one reel light when the at least one reel stops and the predetermined game result does not include one of: "big jackpot" and "one shy".

17. A method, according to claim 15, further comprising:

extending a time of rotation for the at least one reel in response to the predetermined game condition being one of: "big jackpot" and "one shy".

18. A method, according to claim 17, further comprising:

actuating the at least one reel light after the at least one reel stops.

* * * * *